US011306989B2

(12) United States Patent
Peterson

(10) Patent No.: US 11,306,989 B2
(45) Date of Patent: Apr. 19, 2022

(54) DEVICES AND METHODS FOR EXTRACTION OF HIGH PRESSURE CARTRIDGE CASINGS

(71) Applicant: Vista Outdoor Operations LLC, Anoka, MN (US)

(72) Inventor: Bryan P. Peterson, Isanti, MN (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 16/995,395

(22) Filed: Aug. 17, 2020

(65) Prior Publication Data

US 2021/0048264 A1 Feb. 18, 2021

Related U.S. Application Data

(60) Provisional application No. 62/887,139, filed on Aug. 15, 2019.

(51) Int. Cl.
*F41A 21/12* (2006.01)
*F42B 5/02* (2006.01)

(52) U.S. Cl.
CPC ..... *F41A 21/12* (2013.01); *F42B 5/025* (2013.01)

(58) Field of Classification Search
CPC ..... F41A 21/12; F41A 21/02; F41A 21/04
See application file for complete search history.

(56) References Cited

U.S. PATENT DOCUMENTS 2,850,828 A * 9/1958 Sullivan ..... F41A 21/12 42/76.02
3,943,821 A * 3/1976 Seifried ..... F41A 21/12 89/16
4,259,892 A 4/1981 Witt et al.
4,409,881 A * 10/1983 van der Wielen ..... F41A 21/02 89/16
4,577,431 A * 3/1986 Siemers ..... F41A 21/02 164/46
4,641,450 A * 2/1987 Moll ..... C23C 14/0635 42/76.02
4,669,212 A * 6/1987 Jackson ..... B32B 15/01 42/76.02
5,479,737 A * 1/1996 Osborne ..... F41A 21/12 42/76.01
10,451,372 B2 * 10/2019 Stetler ..... F41A 33/00
2006/0260461 A1 11/2006 Rozhkov et al.
2019/0017764 A1 1/2019 Michlin

FOREIGN PATENT DOCUMENTS

BE 878999 A * 3/1980 ..... F41A 21/02
GB 706956 A * 4/1954 ..... F41A 21/04
WO WO-8602719 A1 * 5/1986 ..... F41A 21/20

OTHER PUBLICATIONS

International Search Report and Written Opinion dated Oct. 30, 2020 for PCT/US2020/046678.

* cited by examiner

*Primary Examiner* — Jonathan C Weber
(74) *Attorney, Agent, or Firm* — Reed Smith LLP; Matthew P. Frederick; John M. Cogill

(57) ABSTRACT

Devices and methods for chambering and releasing a high pressure cartridge case from a firearm. In some embodiments, a static chamber insert of high elastic modulus is disclosed. In some embodiments, a dynamic or adaptable chamber insert that radially expands in an out-of-battery configuration and radially contracts in a battery configuration is disclosed.

5 Claims, 5 Drawing Sheets

DEVICES AND METHODS FOR EXTRACTION OF HIGH PRESSURE CARTRIDGE CASINGS

CROSS-REFERENCE TO RELATED APPLICATION

This application claims the benefit under 35 U.S.C. § 119(e) of the earlier filing date of U.S. Provisional Patent Application No. 62/887,139 filed on Aug. 15, 2019, the disclosure of which is incorporated by reference herein.

FIELD OF THE INVENTION

The present invention is directed to rifle chamber modifications or inserts for improving reliability and performance.

BACKGROUND OF THE INVENTION

A rifle chamber and cartridge are subjected to rapid changes in temperature and pressure when a bullet is fired and, subsequently, the spent cartridge casing is ejected from the chamber. Modern rifle designs may employ even greater pressures than previous designs. Moreover, there may be a variety of dimensional variations for cartridges of a given caliber; such variations may not be readily accommodated by a single rifle.

SUMMARY OF THE INVENTION

A gun barrel assembly comprises a gun barrel, a chamber formed at a proximate end of the gun barrel, and a chamber insert. The gun barrel is formed of a material comprising steel and configured for firing a cartridge within a range from .17-.50 caliber. The chamber insert is affixed in the chamber, the chamber insert dimensioned to extend along a body of a cartridge case and terminate proximate a neck of the cartridge case accommodated and fired by the gun barrel assembly. The chamber insert defines an interior surface for interfacing the cartridge casing, and the chamber insert is formed of a material comprising one of a tungsten carbide, a tungsten heavy alloy, and a bulk metallic glass, and the material comprising an elastic modulus that is from about $60\times10^6$ psi to about $200\times10^6$ psi.

A feature and benefit of embodiments is a gun barrel assembly wherein the chamber insert is configured to accommodate and extract a cartridge casing comprising steel due to the chamber insert comprising an elastic modulus of about two to six times greater than the elastic modulus of the cartridge casing.

In embodiments, the gun barrel assembly further includes a cartridge comprising a cartridge casing formed of a material comprising steel, wherein the elastic modulus of the chamber insert is from about two to six times greater than the elastic modulus of the cartridge casing.

In embodiments, the gun barrel assembly further includes said gun barrel shrunk fit onto said chamber insert. A feature and benefit of embodiments is a gun barrel assembly wherein the insert comprises a radial wall thickness that is less than one half of a diameter of a body portion of the chamber insert.

In other embodiments, a gun barrel assembly comprises a gun barrel, a chamber disposed at the proximal end of the gun barrel, and a dynamic insert mounted in the chamber. The gun barrel is configured for firing a cartridge within a range from .17-.50 caliber. The chamber includes a proximal angled wall, a body, and a neck. The dynamic insert is mounted in the chamber and including a wall portion, an angled waist, and an end web, said wall portion defining a plurality of slits that extend through a thickness of said wall portion, said plurality of slits extending axially from an end web disposed at an axial end of the dynamic insert, the dynamic insert being configured to surround an entirety of a cartridge casing. The dynamic insert is slidingly mounted in the chamber and is configured to radially contract and secure the cartridge casing when in a battery configuration and to radially expand and release the cartridge casing when in an out-of-battery configuration. The angled waist interfaces with the proximal angled wall to move the dynamic insert between the battery configuration and the out-of-battery configuration.

In embodiments, the gun barrel assembly further includes the slits dividing the dynamic insert into six segments.

In embodiments, the gun barrel assembly further includes the dynamic insert extending substantially the same axial length as the chamber.

In embodiments, the gun barrel assembly further includes the chamber having a proximal body portion extending substantially axially from the proximal angled wall and comprising a first diameter; and a distal neck portion extending substantially axially from the proximal angled wall toward the barrel and comprising a second diameter that is less than the first diameter.

In embodiments, the gun barrel assembly further includes the dynamic insert extending axially along both the body portion and the neck portion.

In embodiments, the gun barrel assembly further includes wherein the chamber defining a distal angled wall connecting the chamber to the barrel; and wherein the dynamic insert has an angled fore end for interfacing with the distal angled wall to move the dynamic insert between the battery configuration and the out-of-battery configuration.

In embodiments, the gun barrel assembly further includes the end web is a proximal end web formed at a proximal end of the dynamic insert; and the dynamic insert includes a distal end web formed at a distal end of the dynamic insert.

A feature and benefit of embodiments is a gun barrel assembly comprising the chamber and dynamic insert configured to adjustably accommodate and fire cartridges of different sizes.

In still other embodiments, a gun barrel assembly comprises a gun barrel, a chamber disposed at a proximal end of said gun barrel, and an adaptable insert. The gun barrel is configured for firing a cartridge within a range from .17-.50 caliber. The chamber comprises an inner wall comprising a proximal angled wall. The adaptable insert includes a wall portion, an angled waist, and an end web, said wall portion comprising a plurality of segments with slits between the segments, the slits extending through a thickness of said wall portion, the slits extending axially from an end web disposed at an end portion of said wall portion, said adaptable insert being configured to surround at least a portion of a cartridge casing. The adaptable insert is slidingly mounted in the chamber and defines a radial gap between the wall portion and the inner wall of the chamber, and is configured to radially contract and chamber a first cartridge casing when in a battery configuration and to radially expand and release the first cartridge casing when in an out-of-battery configuration. The angled waist interfaces with the proximal angled wall to move the adaptable insert between the battery configuration and the out-of-battery configuration. The adaptable insert is configured to accommodate and fire cartridges of different sizes from the chamber and the radial gap varies when the adaptable insert holds different size cartridges of the same caliber.

A feature and benefit of embodiments is a gun barrel assembly wherein the adaptable insert is configured to selectively accommodate and fire any of at least a first cartridge and a second cartridge in the chamber, the second cartridge comprising one or more dimensions different than the first cartridge.

In embodiments, the gun barrel assembly further includes the one or more different dimensions including a body diameter, an axial length, and a headspace.

In embodiments, the gun barrel assembly further includes the first and second cartridges being .22 caliber, the first cartridge has a body diameter of 0.227 in. and the second cartridge has a body diameter of 0.243 in.

In embodiments, the gun barrel assembly further includes the adaptable insert defining an expansion gap between the plurality of slits when holding a cartridge; wherein the expansion gap is about 0.001 in. when holding the first cartridge and the expansion gap is about 0.010 in. when holding the second cartridge.

In embodiments, the gun barrel assembly further includes the chamber defining a distal angled wall connecting the chamber to the barrel; and wherein the adaptable insert has an angled fore end for interfacing with the distal angled wall to move the adaptable insert between the battery configuration and the out-of-battery configuration.

In embodiments, the gun barrel assembly further includes the end web being a proximal end web formed at a proximal end of the insert; and the adaptable insert includes a distal end web formed at a distal end of the adaptable insert.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
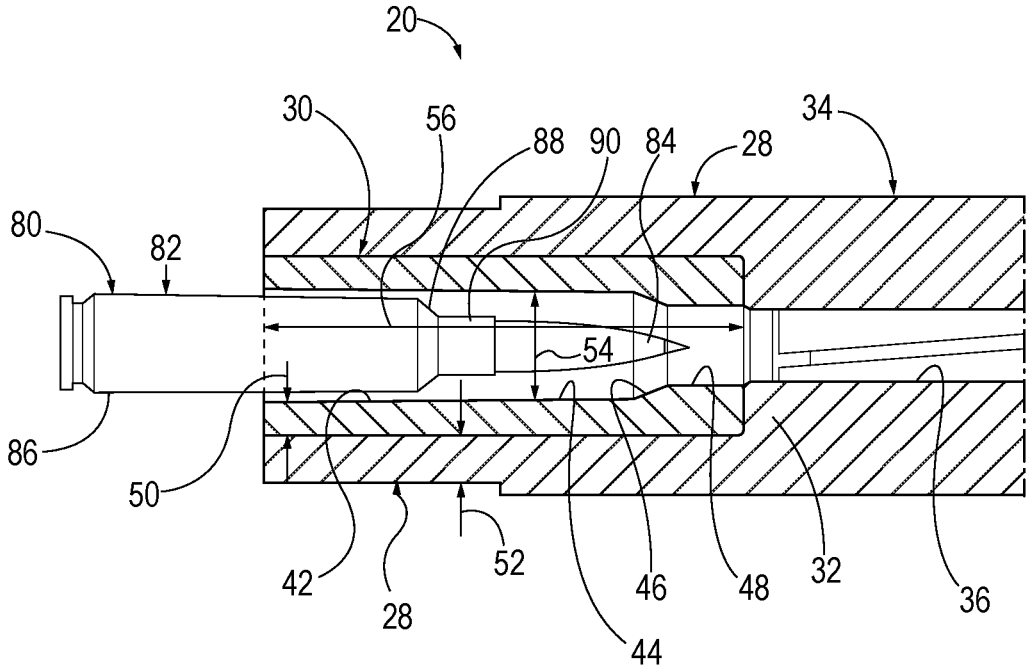
FIG. 1 is a partial cross-sectional view of an example static insert in a barrel of a rifle in accord with embodiments of the present disclosure.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

As shown in FIG. 1 and generally applicable to any embodiments of the present disclosure, an example gun barrel assembly 20 partially chambers a cartridge 80. The cartridge 80 is provided with a cartridge case 82 that includes propellant inside the case 82 and a bullet 84. The cartridge case 82 has a body 86, an angled shoulder 88, and a neck 90. A proximal end 32 of the gun barrel 34 includes a chamber 28 that holds the cartridge case 82 and allows the cartridge case 82 to be ejected. The gun barrel 34 is in a generally cylindrical shape with a bore 36 extending axially to guide the bullet 84 of the cartridge 80 when fired as a projectile. The disclosed embodiments are beneficial for extracting a cartridge case 82 in 'high pressure' weapons systems (e.g., firing pressures of 60,000 pounds per square inch (psi) or more). Such high pressure weapons systems impart significant strain on the gun barrel assembly 20 due to high temperatures, high pressures, shock loads, and the like. Various embodiments have utility when using steel or other materials for a cartridge case 82. Such steel cases may offer strength, cost, and manufacturability benefits as compared to conventional configurations, such as e.g. a brass case, particularly for high pressure weapon systems.

Figure 2:
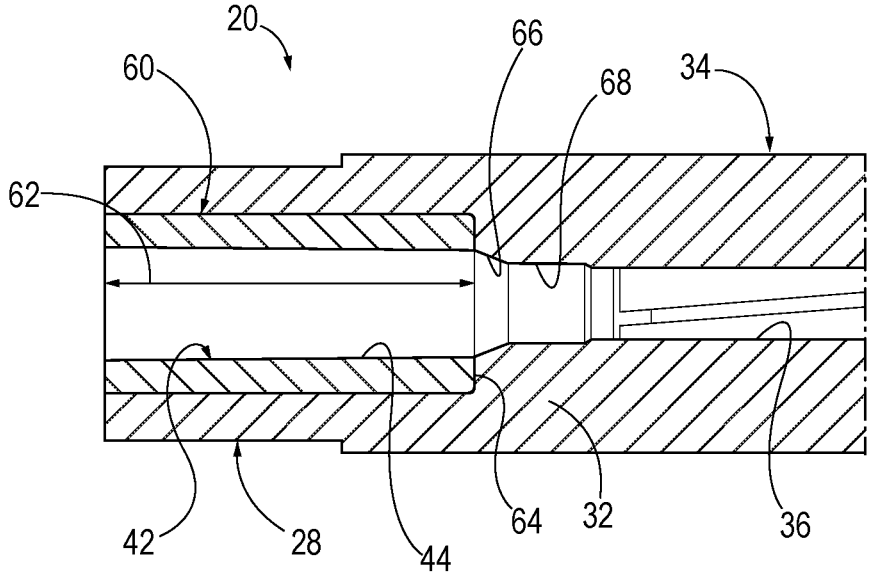
FIG. 2 is a partial cross-sectional view of another embodiment of a static insert in the barrel of FIG. 1.

Referring to FIGS. 1 and 2, the gun barrel assembly 20 includes a chamber 28 mounting a static chamber insert 30, 60 at a proximal end 32 of a gun barrel 34 that defines a bore 36 at a distal end thereof. The static chamber insert 30, 60 includes an inner surface 42 that defines a body portion 44, an angled shoulder portion 46, and a neck portion 48 that is of a smaller diameter than the body portion 44. The static chamber insert 30 may be formed from a material with a high elastic modulus, such as tungsten or tungsten alloys. The static chamber insert 30 also defines a radial wall thickness 50. In the illustrated embodiments, the wall thickness 50 is less than a thickness 52 of the chamber 28 and less than half of a diameter 54 of the body portion 44, although these relative dimensions may vary, including embodiments wherein the static chamber insert 30 is effectively an inner liner for the chamber 28, and embodiments where the chamber 28 is entirely comprised by the static chamber insert 30.

In the embodiment shown in FIG. 1, the static chamber insert 30 is dimensioned with a length 56 to substantially coextend with a high pressure cartridge case 82, including coextending with one or more of the angled shoulder 88 and the neck 90. In the embodiment shown in FIG. 2, a static chamber insert 60 is dimensioned to extend over a portion of the full length of the casing 82, with the static chamber insert 60 having an axial length 62 that is coextensive with the body 86 of the cartridge case 82. A distal end 64 of the static chamber insert 60 terminates proximate the shoulder 88 of the cartridge, such that the chamber 28 of the gun barrel assembly 20 may define an inner shoulder portion 66 and neck portion 68 for receiving the cartridge 80. In other embodiments, the static chamber insert 60 may extend along about 50% or about 75% of the length of the body 86 of the cartridge case 82. This embodiment is otherwise substantially similar to FIG. 1.

As noted, the static chamber insert 30, 60 is fabricated from a material having a high modulus of elasticity, defined herein as a modulus of elasticity that is at least $60\times10^6$ pounds per square inch, and a sufficiently high yield strength. In some embodiments, the static chamber insert 30, 60 comprises a tungsten alloy, a bulk metallic glass ("BMG"), or other material exhibiting comparable elastic modulus and yield strength. For example, the static chamber insert 30, 60 may comprise one of a tungsten carbide and a tungsten heavy alloy. In certain embodiments tungsten carbide includes tungsten and carbon with tungsten comprising about 50-96% of the alloy. Other tungsten-based materials are contemplated including other ratios of tungsten-to-carbon and materials including about 0-20% of cobalt and other elements. A tungsten heavy alloy may be formed from about 80% or more of tungsten, about 90% or more of tungsten, or about 95% or more of tungsten. Such tungsten heavy alloys may include about 0-20% or 0-10% of one or more of iron, copper, nickel, molybdenum, or similar elements. A BMG is a type of amorphous metal alloy (i.e., having a disordered atomic-scale structure) that is based on one or more of zirconium, palladium, iron, titanium, copper, and magnesium. BMG typically is formed from two, three, four or more elements that are cooled with a disordered state instead of a crystalline structure. BMG is formed with a thickness of about 20-50 microns up to about 2 cm.

In certain embodiments, the static chamber insert 30, 60 is affixed within the chamber 28 of the gun barrel assembly 20, which may be formed of various materials such as steel alloys. In some embodiments, the gun barrel 34 and chamber 28 are shrink fit onto the static chamber insert 30, 60. For example, the gun barrel 34 and chamber 28 may be heated to expand, placed over the static chamber insert 30, 60, and subsequently shrink during cooling to provide a permanent interference fit. In other embodiments, the static chamber insert 30 may be mounted in a press fit or other similar permanent or semi-permanent arrangements including those used in the firearm industry for assembling barrels, bolts, and accessories thereto. Further embodiments may include a fastener through a radial cross-drill perpendicular to the axis of the gun barrel 34 or the chamber 32, a cross pin extending off-axis through a majority or all of the barrel, a roll pin mounted around the barrel in a groove, or the like. The above mounting arrangements may be supplemented by set screws, collars, saddles, or the like.

Functionally, the expansion and relaxation of the disclosed chamber insert are reduced relative to that of the high pressure cartridge casing. The elastic modulus of the steel casing is typically about $30\times10^6$ pounds per square inch. After discharge of the cartridge 80, the case 82 undergoes a relaxation in strain, whether the deformation of the case was elastic or plastic. Meanwhile, in certain embodiments of this invention, the expansion and relaxation of the chamber 30 is substantially less due to the high modulus of elasticity. Accordingly, the cartridge case 82 will relax more than the chamber 30, enabling the cartridge casing 82 to be removed from the chamber 30 without excessive force requirements.

In various embodiments of the disclosure, a static chamber insert 30, 60 is formed from a material having a modulus of elasticity much higher than the case of the high pressure cartridges to be contained therein. In this way, the expansion as well as the relaxation of the chamber is reduced relative to the cartridge case 82 such that the magnitude of the case 'relaxation' can be reduced and still result in a clearance with the chamber post-firing. Theoretically, a chamber wall (or insert) that exhibits zero radial deflection under load would enable the use of any cartridge case material, including any steel alloys, because there will always be a relaxation in strain that follows the modulus of elasticity slope while the dimension of the chamber remains fixed, even after plastic deformation. Because such a zero-deflection chamber wall or insert is not feasible, embodiments of the present disclosure utilize high modulus materials, such as tungsten carbide, tungsten heavy alloys, or BMG, as elastic strain is driven primarily by the elastic modulus value. In some embodiments, chamber materials exceeding $98\times10^6$ pounds of force per square inch (psi) are utilized—more than three times that of steel alloys (typically about $30\times10^6$ psi). In some embodiments, the static chamber insert 30, 60 is formed from materials having elastic moduli that are within a range from about $60\times10^6$ psi up to about $200\times10^6$ psi, in other words, ranging from about two times to six times that of steel alloy cartridge casing materials. Because of the high elastic modulus of the static chamber insert 30, 60, the use of cartridge cases 82 having a wide range of material properties is enabled.

It will be appreciated that, due to similar material properties between conventional weapon barrels and chambers (formed of steel or steel alloys) and steel cartridge cases, there is a propensity for steel cases to form a quasi-interference fit with the chamber of the weapon when chamber pressures exceed the yield strength of the cartridge case material. Such quasi-interference fits can result in excessive chamber-case extraction forces (e.g., greater than 500 pounds of force for 7.62×51 mm-based weapon systems). The excessive chamber-case extraction forces increase the stresses required of extractors, thereby reducing extractor life. By contrast, the present disclosure results in significantly reduced extraction forces, such as about 150 pounds of force or less for 7.62×51 mm-based weapon systems.

Because of the similarity in the elastic/plastic deformation properties of the materials in conventional arrangements, i.e. a steel barrel and chamber (elastic) and steel case (plastic), both the cartridge case 82 and the chamber (or insert) tend to deflect to the same extreme deflection at their interface during firing of the cartridge 80, then undergo relaxations afterwards (following the Modulus of Elasticity slope), such that after firing, the cartridge case 82 may have the same dimension at the interface of the chamber 102. If the cartridge case 82 yield strength is insufficiently low, there is not enough 'relaxation' possible for the case 82 to result in a post-firing diameter smaller than the diameter of a static chamber (or chamber insert) that only undergoes elastic deformation during firing. This exacerbates the problem of the quasi-interference fit and attendant excessive extraction forces. By contrast, embodiments of the present disclosure maintain a sufficient difference between the respective elastic moduli of the cartridge case 82 and the static chamber insert 30, 60 so as to circumvent this issue.

Figure 3:
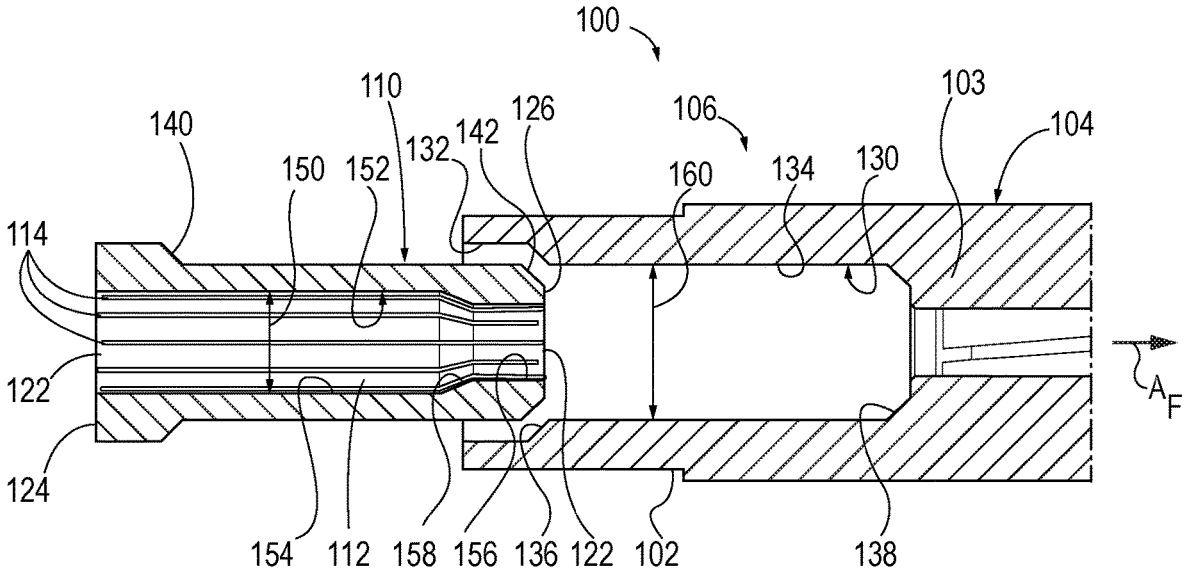
FIG. 3 is a partial cross-sectional view of an example dynamic insert in a barrel of a rifle in accord with other embodiments of the present disclosure in a battery configuration.
Figure 4:
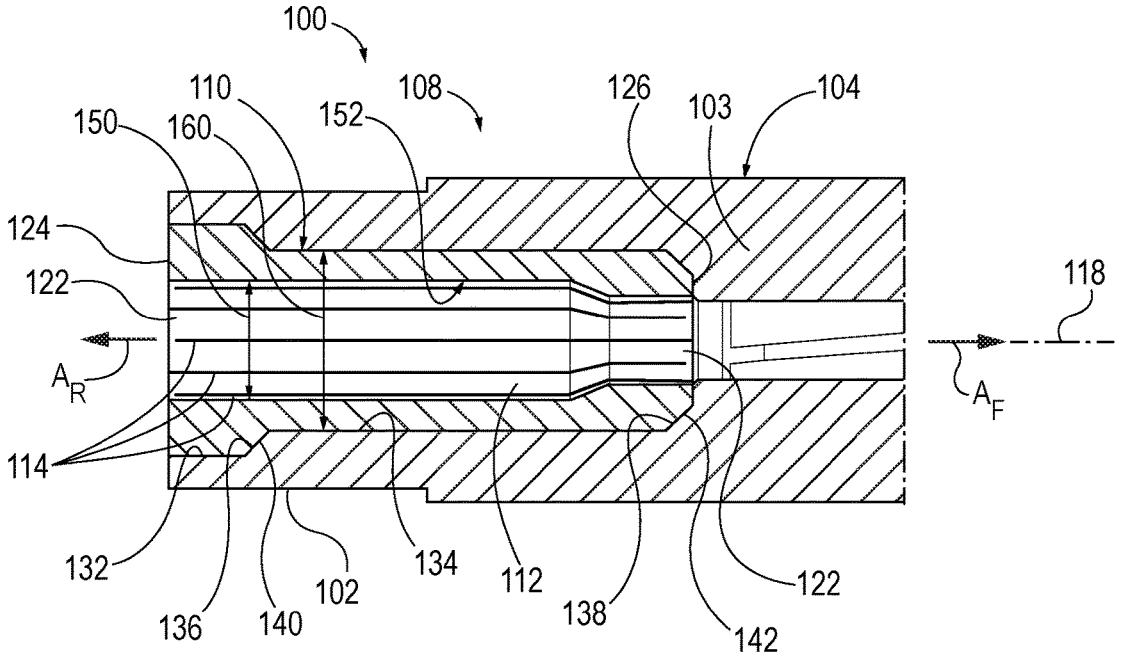
FIG. 4 is a view of the embodiment of the dynamic insert of FIG. 3 in a non-battery configuration.

Referring to FIGS. 3-6, another embodiment of a gun barrel assembly 100 includes a dynamic chamber insert 110 inserted to a chamber 102 at a proximal end 103 of a gun barrel 104. In FIG. 3, the dynamic chamber insert 110 is depicted in an out-of-battery or "open" configuration 106 exaggerated in an axial direction for illustrative purposes; typically the out-of-battery configuration 106 occurs with the dynamic chamber insert 110 slightly backed out before full engagement with the chamber 102. In FIG. 4, the dynamic chamber insert 110 is depicted in a battery or "closed" configuration 108 ready for firing. The dynamic chamber insert 110 is so-named because it is slidingly engaged to the chamber 102 of the gun barrel 104 and is also configured to radially expand and contract about the cartridge case 82 of the cartridge 80. Thus, the cartridge 80 is held in the dynamic chamber insert 110 in the manner of a collet.

Figure 5:
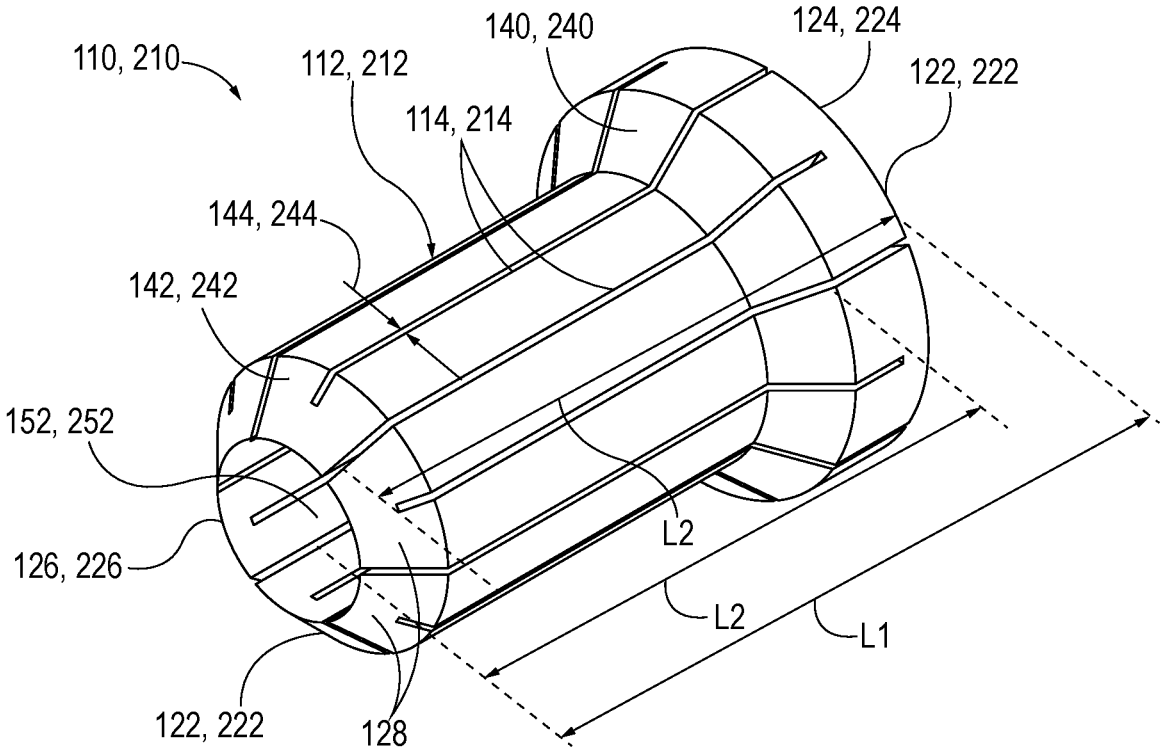
FIG. 5 is a front isometric perspective view of the embodiment of the dynamic insert of FIG. 4.
Figure 6:
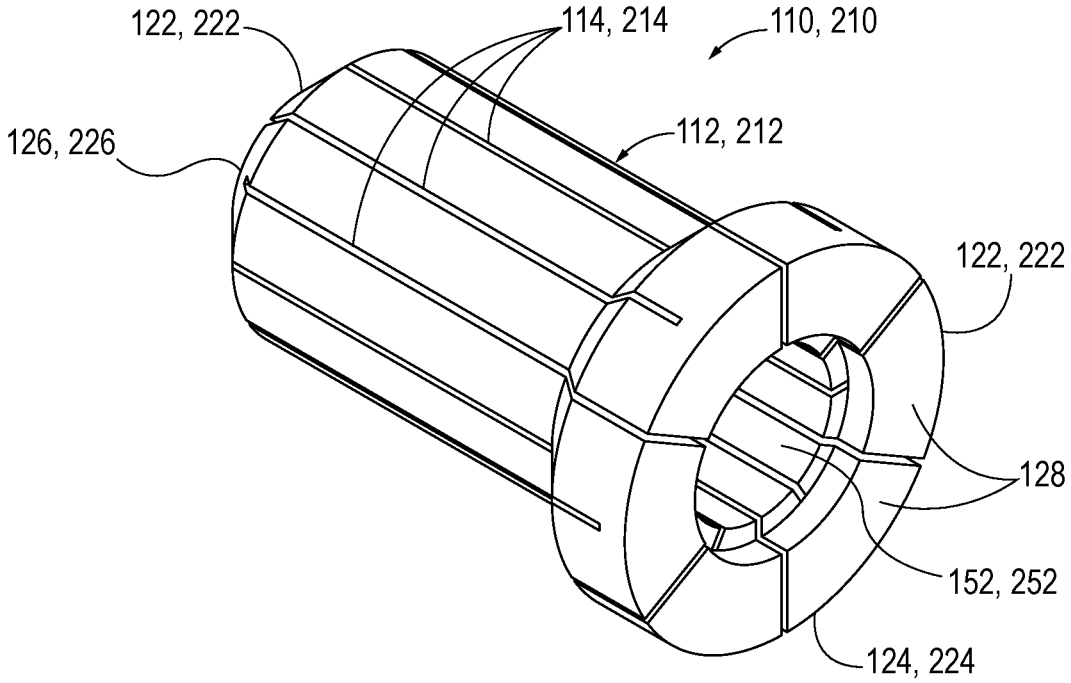
FIG. 6 is a rear isometric perspective view of the embodiment of the dynamic insert of FIG. 4.

In certain embodiments, the dynamic chamber insert 110 includes a wall portion 112 that defines a plurality of slits 114 that extend through a thickness of the wall portion 112. In certain embodiments, the plurality of slits 114 extend in an axial direction parallel to a bore axis 118 of the gun barrel 104. In certain embodiments, the dynamic chamber insert 110 includes at least one web 122 at an axial end from which the plurality of slits 114 extend. In some embodiments, the at least one web 122 is disposed at a proximal end 124 of the dynamic chamber insert 110; in some embodiments, the at least one web 122 is disposed at a distal end 126 of the dynamic chamber insert 110. In embodiments with one web 122, the slits 114 may extend to the opposite end of the insert 110 (e.g., from the proximal end 124 to the distal end 126), such that the opposite end of the insert 110 is open, in other words, with no interconnecting web. In other embodiments, both the proximal end 124 and the distal end 126 include a respective web 122, with the slits 114 alternating in origination from the proximal end 124 and the distal end 126. In certain embodiments, the web 122 acts to integrate the dynamic chamber insert 110 so that the dynamic chamber insert 110 is an integrally formed unitary component such as the dynamic chamber insert 110 shown in FIGS. 5-6. As best shown in FIGS. 5-6, in certain embodiments the dynamic insert 110 may be divided into segments 128, for example six segments 128 of equal size, spread about the circumference of the dynamic insert 110. The at least one web 122 therefore is defined by axial ends of the segments 128 and contributes to a resilient bias of the dynamic insert 110 in a radially outward direction, i.e., expansion. The dynamic chamber insert 110 has an axial length L1, whereas the slits 114 extend for a relatively shorter axial length L2. The length L2 of the slits 114 may be from about 80% to about 99% of the length L1 of the dynamic chamber insert 110, and in certain embodiments may be about 95% of the length L1. In certain embodiments, the slits 114 do not extend the entire length L1, such that the web 122 bridges the slits 114 between two corresponding legs of each segment. In this manner, the dynamic chamber insert 110 is unitary as a continuous serpentine cord of material. The unitary nature of the dynamic chamber insert 110 provides ease of manufacturing assembly, as well as disassembly/reassembly or replacement during maintenance of the gun barrel 104.

Referring to FIGS. 3 and 4, the dynamic chamber insert 110 is sized to closely fit within the chamber 102 of the gun barrel assembly 100. The chamber 102 has an inner wall 130 defining a foot portion 132 and a body portion 134 connected by a proximal angled wall 136. A distal angled wall 138 connects the body portion 134 of the chamber to the barrel 104. Correspondingly, the dynamic chamber insert 110 extends axially along the inner wall 130 and includes an angled waist 140 for interfacing with the proximal angled wall 136 and, in some embodiments, also includes an angled fore end 142 for interfacing with the distal angled wall 138. By interfacing with the proximal angled wall 136 in this manner, the dynamic chamber insert 110 has freedom to radially expand when moved in an axially rear direction $A_R$ (e.g., when in the out-of-battery configuration 106 before and after firing) and is forced to radially contract when moved in an axially forward direction $A_F$ (e.g., when loading a cartridge and moving to the battery configuration 108). The slits 114 define a variable expansion gap 144 (FIG. 5) between portions of the wall portion 112 that varies to be relatively wider in the out-of-battery configuration 106 than in the battery configuration 108. In some embodiments, the foot portion 132 of the chamber 102 may have various guiding or retention features to engage with the dynamic chamber insert 110 (or a complementary structure thereon) to prevent accidental back-out of the dynamic chamber insert 110; such structures may be a catch, complementary indent-detent, slot, or the like.

The dynamic chamber insert 110 is resiliently biased toward a rest position with an inner diameter 150 that is greater than the cartridge case 82 diameter, resulting in ready release of the cartridge case 82 once the dynamic chamber insert 110 moves axially in rearward direction $A_R$. The axial movement and resulting radial contraction and expansion of the dynamic chamber insert 110 may be driven, for example, by the action of the bolt (not shown). Therefore, the dynamic chamber insert 110 automatically expands radially during extraction of the cartridge case 82. When the cartridge 80 is loaded to the battery configuration before firing, the dynamic chamber insert 110 contracts radially to the dimension of the cartridge 80 and firmly holds the cartridge case 82. In certain embodiments, the dynamic chamber insert 110 includes an inner wall 152 generally shaped to correspond to the cartridge 80 and surround the cartridge 80, including a wide body portion 154, a reduced-diameter neck portion 156, and an angled surface 158 connecting the two portions.

In certain embodiments, the dynamic chamber insert 110 is sized to surround a substantial entirety of the cartridge case 82, e.g., extending along the entire body 82, the body 82 and the shoulder 88, or the entire cartridge case 82 including the shoulder 88 and the neck 90. In other embodiments, the dynamic chamber insert 110 may extend along only a portion of the body 82 of the cartridge case 82. The wide body portion 154 is sized to closely correspond to a diameter 160 of the inner wall 134 of the chamber 102 when in the battery configuration 108. During cartridge case extraction, the dynamic chamber insert 110 moves to the out-of-battery configuration 106 and expands radially to relieve pressure on the cartridge casing 82 to allow for extraction, even overcoming any quasi-interference fit that may occur between the dynamic chamber insert 110 and the fired cartridge casing 82.

It will be appreciated that in certain applications, the dynamic chamber insert 110 may not fit tightly within the chamber 102, leaving a radial gap to the inner wall 130 (similar to a radial gap 246 shown in FIGS. 7-8) and/or an axial gap in front of the distal end 126. These gaps allow the chamber insert 110 to release the case 82 without the dynamic chamber insert 110 being entirely removed from the chamber 102. In these embodiments, the dynamic chamber insert 110 is secured in battery by contact between the angled waist 140 and proximal angled wall 136 and/or the angled fore end 142 and distal angled wall 138, with no contact being made between the foot portion 132 and body portion 134 of the chamber 102 and the corresponding portions of the outer diameter of the dynamic chamber insert 110. In these embodiments, in order to release the case 82, the dynamic chamber insert 110 need only move and expand enough to release the case, and may maintain contact with some portions of the angled waist 140 and proximal angled wall 136 and/or the angled fore end 142 and distal angled wall 138 throughout the cycle between in battery and out of battery configurations 106, 108. In other words, the movement between in battery and out of battery configurations of the dynamic chamber insert 110 may consist of the dynamic chamber insert 110 sliding in and out along the angled waist 140 and proximal angled wall 136 and/or the angled fore end 142 and distal angled wall 138. In certain embodiments, the dynamic chamber insert 110 may make contact with the foot portion 132 and/or body portion 134 of chamber 102 when in the out of battery position, such contact defining the end of the out of battery movement of the dynamic chamber insert 110. Moreover, the dynamic chamber insert 110 may not tightly retain the cartridge case 82 when initially in battery and before firing, instead providing some degree of radial clearance similar to conventional chambers.

Figure 7:
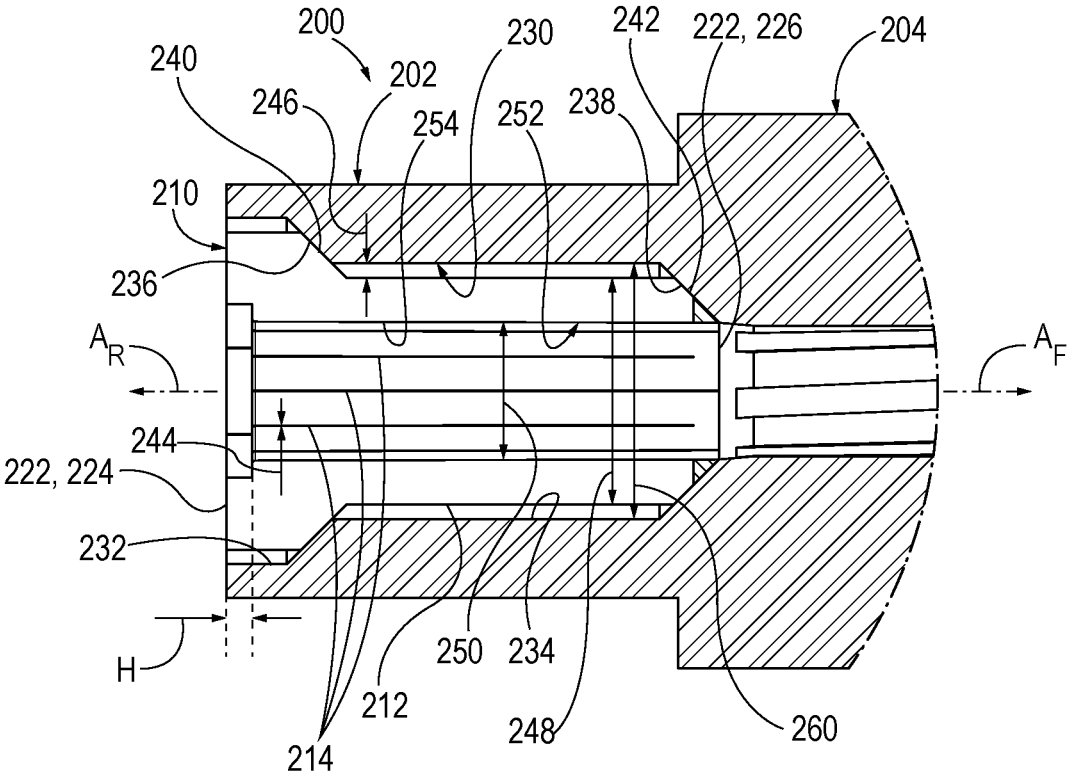
FIG. 7 is a partial cross-sectional view of another example adaptable insert in a barrel of a rifle in accord with other embodiments of the present disclosure when mounting a cartridge of a first size.
Figure 8:
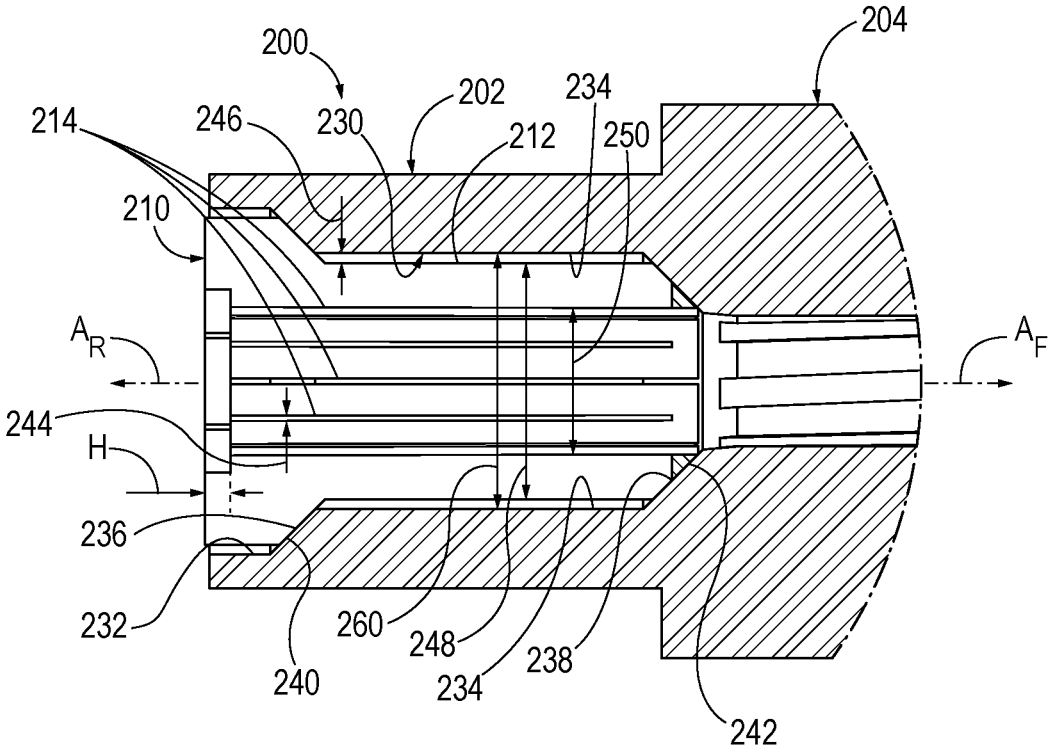
FIG. 8 is a partial cross-sectional view of the embodiment of the dynamic insert of FIG. 6 when mounting a cartridge of a second size.

Referring to FIGS. 5-8, an adaptable chamber insert 210 is shown in a given chamber 202 of a gun barrel 204 while accommodating a first cartridge (FIG. 7) or a second cartridge (FIG. 8). In certain embodiments, the first and second cartridges (not shown) are of a same caliber but have at least some dimensional variation. As shown in FIGS. 5-6, the adaptable chamber insert 210 may be structurally similar to the dynamic chamber insert 110, including a wall portion 212 that defines a plurality of slits 214. The plurality of slits 214 extend in an axial direction parallel to a bore axis 218 of the gun barrel 204. In certain embodiments, the adaptable chamber insert 210 may be sized to surround a substantial entirety of the cartridge case 82 or extend along only a portion of the body 82 of the cartridge case 82. The adaptable chamber insert 210 includes at least one web 222 at an axial end from which the plurality of slits 214 extend, which web 222 may be disposed at a proximal end 224 of the adaptable chamber insert 210, a distal end 226 of the adaptable chamber insert 210, or both proximal and distal ends 224, 226. In embodiments with one web 222, the slits 214 may extend to the opposite end of the insert 210 (e.g., from the proximal end 224 to the distal end 226), such that the opposite end of the insert 210 is open, in other words, with no interconnecting web. The adaptable chamber insert 210 may be an integrally formed unitary component such as the dynamic chamber insert 110 shown in FIGS. 5-6. As best shown in FIGS. 5-6, the adaptable insert is divided into segments 228, for example six segments 228 of equal size, spread about the circumference of the adaptable insert 210. The adaptable chamber insert 210 has an axial length L1, whereas the slits 214 extend for a relatively shorter axial length L2 that may be from about 80% to about 99% of the length L1 of the adaptable chamber insert 210, and in certain embodiments may be about 95% of the length L1. In this manner, the adaptable chamber insert 210 is unitary as a continuous serpentine cord of material.

The adaptable chamber insert 210 is sized to closely fit within the chamber 202 of the gun barrel assembly 200. The chamber 202 has an inner wall 230 defining a foot portion 232 and a body portion 234 connected by a proximal angled wall 236. A distal angled wall 238 connects the body portion 234 of the chamber to the barrel 204. Correspondingly, the adaptable chamber insert 210 extends axially along the inner wall 230 and includes an angled waist 240 for interfacing with the proximal angled wall 236 and an angled fore end 242 for interfacing with the distal angled wall 238. By interfacing with one or more of the proximal angled wall 236 and the distal angled wall 238 in this manner, the adaptable chamber insert 210 has freedom to radially expand when moved in an axially rear direction $A_R$ and is forced to radially contract when moved in an axially forward direction $A_F$ (e.g., when loading a cartridge and moving to the battery configuration). Depending on the particular dimensions of the embodiment and selected cartridge 80, the distal end 226 may not be able to be inserted as far in the forward direction $A_F$, as shown in FIGS. 7-8. In other words, when the adaptable chamber insert is secured around the larger of the cartridges that it is configured to accept, the distal end 226 may not be able to be inserted as far in in the forward direction $A_F$, as shown in FIGS. 7-8. The slits 214 define a variable expansion gap 244 between portions of the wall portion 212. In some embodiments, the foot portion 232 of the chamber 202 may have various guiding or retention features to engage with the adaptable chamber insert 210 (or a complementary structure thereon) to prevent accidental back-out of the adaptable chamber insert 210; such structures may be a catch, complementary indent-detent, slot, or the like.

Notably, as shown in FIGS. 7-8 the adaptable chamber insert 210 provides a radial gap 246 between the wall portion 212 and the inner wall 230 of the chamber 202. The radial gap 246 may exist even when the angled waist 240 and the angled fore end 242 are respectively engaged with the proximal and distal angled walls 236, 238. The radial gap 246 allows for the adaptable chamber insert 210 to adapt in size, including varying an outer diameter 248, to hold various cartridges of varying dimensions and to release the largest size case 82 that it is configured for without needing to withdraw the adaptable chamber insert 210 entirely from the chamber 202. In these embodiments, the adaptable chamber insert 210 is secured in battery by contact between the angled waist 240 and angled fore end 242 are respectively engaged with the proximal and distal angled walls 236, 238, with no contact being made between the wall portion 212 and the inner wall 230 of the chamber 202. In these embodiments, in order to release the case 82 or expand to accept a larger case, the adaptable chamber insert 210 need only move and expand enough to release the case and/or accept a new case, and may maintain contact with some portions of the angled waist 240 and angled fore end 242 and respective proximal and distal angled walls 236, 238 throughout the cycle between in battery and out of battery configurations. In other words, the movement between in battery and out of battery configurations of the adaptable chamber insert 210 may consist of the adaptable chamber insert 210 sliding in and out along the angled waist 240 and angled fore end 242 and respective proximal and distal angled walls 236, 238. In certain embodiments, the wall portion 212 may make contact with the inner wall 230 of the chamber 202 when in the out of battery position, such contact defining the end of the out of battery movement of the adaptable chamber insert 210. Moreover, the adaptable chamber insert 210 may not tightly retain the cartridge case 82 when initially in battery and before firing, instead providing some degree of radial clearance between the adaptable chamber insert 210 and the case 82, similar to conventional chambers, which may be achieved by indexing the adaptable chamber insert 210 along the angled waist 240 and angled fore end 242 and respective proximal and distal angled walls 236, 238 to respective different chamber positions for respective different size cartridges by controlling the movement of the adaptable chamber insert 210 in the axial direction $A_F$. In certain embodiments, the cartridges are of a same caliber but have one or more other dimensions varied, for example the dimensions of the case, for example diameter and length of the case.

The adaptable chamber insert 210 is resiliently biased toward a rest position with an inner diameter 250 that is greater than the cartridge 80 caliber, resulting in ready release of the cartridge 80 once the dynamic chamber insert 210 moves axially in rearward direction $A_R$. The axial movement and resulting radial contraction and expansion of the adaptable chamber insert 210 may be driven, for example, by the action of the bolt (not shown). Therefore, the adaptable chamber insert 210 automatically expands radially during extraction of the cartridge case 82. When the cartridge 80 is loaded before firing, the adaptable chamber insert 210 contracts radially to the dimension of the cartridge 80 and firmly holds the cartridge case 82. As noted above, the adaptable chamber insert 210 may contract radially when inserted into the chamber 202 in the forward axial direction $A_F$. The adaptable chamber insert 210 includes an inner wall 252 generally shaped to correspond to the cartridge 80, including a body portion 254. In embodiments for .22 caliber cartridges, the inner wall 252 may have a consistent diameter and cylindrical shape, omitting the neck portion and angled surface shown in FIGS. 3-4.

Figure 9:
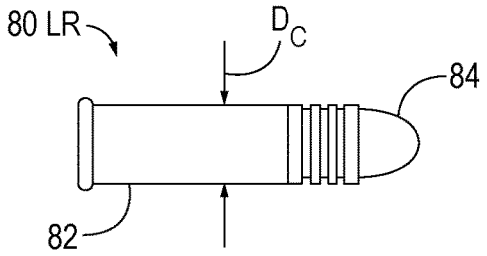
FIG. 9 is a plan view of an example .22 caliber long rifle cartridge.
Figure 10:
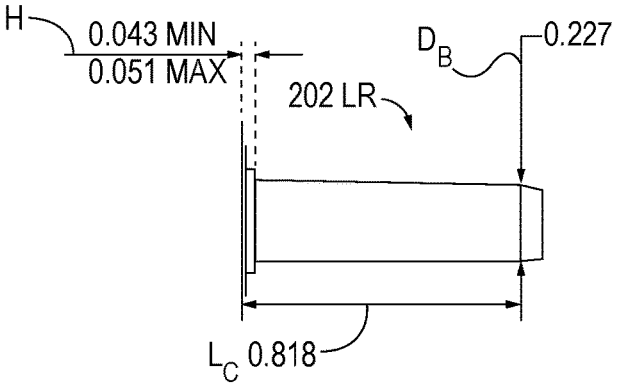
FIG. 10 is a plan view of an example .22 caliber long rifle chamber.
Figure 11:
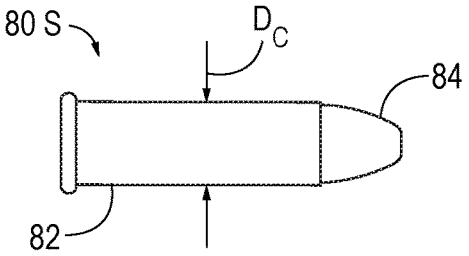
FIG. 11 is a plan view of an example of a .22 caliber super cartridge.
Figure 12:
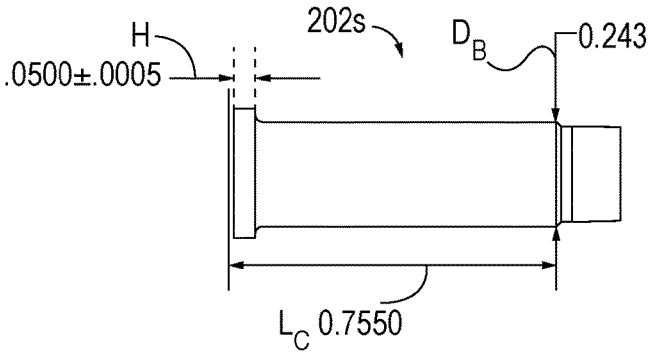
FIG. 12 is a plan view of an example .22 caliber super chamber.

In one example for the adaptable dynamic chamber insert 210, the first cartridge 80LR is a .22 long rifle ("22 LR") cartridge as shown in FIGS. 9-10 and the second cartridge is a .22 caliber super ("22 Super") cartridge as shown in FIGS. 11-12. The 22 LR has various standardized dimensions including, for example, a body diameter $D_B$ of 0.227 inches and a headspace H in a range of 0.043-0.051 in. The body diameter $D_B$ corresponds to a casing diameter $D_C$ of the cartridge 80LR. Moreover, as shown in FIG. 10, a corresponding chamber 202LR for a 22 LR has standardized dimensions including a chamber length $L_C$ of 0.818 in.

By contrast, a chamber 202S for a 22 Super cartridge provides a body diameter $D_B$ of 0.243 in. (i.e., 0.016 in. larger than the 22 LR cartridge) along with a headspace H of 0.0495-0.0505 in. and a chamber length $L_C$ of 0.7550 in. The adaptable insert 210 of certain embodiments provides a length L1 (FIG. 5) and headspace H (FIGS. 7-8) that may be substantially equal to the chamber length $L_C$ and headspace H of the standard 22 LR of FIGS. 9-10, i.e., respectively 0.818 in., and 0.043-0.051 in. Due to its expandable arrangement, the adaptable insert 210 can accommodate, securely hold, fire, and eject cartridges of either the 22 LR or the 22 Super design. One skilled in the art will appreciate that an adaptable insert 210 applicable to the present disclosure may be implemented for a variety of groups of cartridges of similar sizes, such as various cartridges of a given caliber. Accordingly, the following Table 1 provides example cartridge arrangements for a range of .22 caliber options that may be applicable to the present disclosure by being accommodated within the adaptable chamber insert 210.

TABLE 1

Selected Dimensions of .22 Caliber Cartridges and Chambers

| Name | Body Diameter $D_B$ (in.) | Headspace H (in.) | Chamber Length $L_C$ (in.) |
|---|---|---|---|
| 22 LR | 0.227 | 0.043-0.051 | 0.818 |
| 22 Super | 0.243 | 0.0495-0.0505 | 0.7550 |
| 22 Short | 0.227 | 0.043-0.051 | 0.474 |
| 22 Long | 0.226 | 0.043-0.051 | 0.818 |
| 22 | 0.2435 | 0.050-0.056 | 0.980 |

TABLE 1-continued

Selected Dimensions of .22 Caliber Cartridges and Chambers

| Name | Body Diameter $D_B$ (in.) | Headspace H (in.) | Chamber Length $L_C$ (in.) |
|---|---|---|---|
| Winchester Magnum 22 Winchester Rimfire | 0.2435 | 0.050-0.056 | 0.980 |

FIGS. 7 and 8 approximate the arrangement of the adaptable chamber insert 210 for 22 LR cartridge and a 22 Super cartridge. Due to the smaller diameter of the 22 LR cartridge, the radial gap 246 between the adaptable dynamic insert 210 and the inner wall 212 of the chamber 202 is larger with the 22 LR cartridge (FIG. 7) than the corresponding radial gap 246 with the 22 Super cartridge (FIG. 8). The use of an adaptable chamber insert 210 allows this variety of cartridges to be readily fired from the same firearm without rupture of the cartridge case during firing, including the same gun barrel assembly 200, gun barrel 204, chamber 202, and adaptable chamber insert 210. Moreover, the chamber 202 of this example may have a larger diameter 260 than the chamber diameter 160 illustrated in FIGS. 3-4 for the dynamic chamber insert 110 for a barrel of the same caliber. In some embodiments and certain cartridge applications, the radial gap 246 may be effectively eliminated (e.g., a gap of about 0 in.) with a close fit within the inner wall 212 of the chamber 202, for example when the adjustable chamber insert is configured to receive the largest cartridge that it is designed to accommodate. Likewise, the variable expansion gap 244 may be effectively eliminated (e.g., a gap of about 0 in.) in some embodiments.

Various modifications to the above examples are contemplated to be within the scope of the present disclosure. The various angled surfaces of the chamber, chamber inserts, and cartridges are illustrated as about 45 degree angles relative to the gun barrel axis, although other angles are contemplated including from about 15 degrees to 75 degrees and from about 30 degrees to about 60 degrees. Certain embodiments herein are specifically addressed to projectiles from .17 caliber to .50 caliber. In some embodiments, the cartridge has a .17 caliber, .223 caliber, or 5.56 NATO projectile. In other embodiments, the cartridge has a .22 caliber projectile. In embodiments, cartridges may have a lead-free, lead, or jacketed bullet. The present disclosure may also be applicable to centerfire as well as rimfire cartridges, as well as various types of firearms including handguns, rifles, semiautomatics, automatics, combinations thereof, and the like. Applicable rifles may include match, sporting, and shotgun styles.

In certain embodiments, one of ordinary skill in the art will appreciate that the inserts 110, 210 may be actuated by a bolt that pushes the insert 110, 210 forward in the in the axial direction $A_F$ when chambering a cartridge 80. After firing, the insert 110, 210 may reverse direction and move out of battery when the bolt reverses in the in the axial direction $A_F$, for example simply by the pressure of the bolt on the insert 110, 210 being removed, or by some mechanical connection to the bolt or bolt carrier, or by a separate mechanical action initiated by the user. An extractor associated with the bolt or bolt carrier may engage with the case 82 as the bolt is being extracted, and at least initially, any friction between the case 82 and the insert 110, 210 may assist the insert 110, 210 in its initial out of battery motion.

The chamber 102, 202 may include a mechanical stop to limit the insert's 110, 210 out of battery motion while the bolt travels further in the axial direction $A_F$ in order for the bolt and extractor to eject the spent case 82 and/or chamber a new cartridge 80.

In some embodiments of either the dynamic chamber insert 110 or adaptable chamber insert 210, the slits 114, 214 may include a pliable filler or sheet of material to occupy the space of the variable expansion gap 144, 244 while preventing any buildup of residue or debris that results from firing of cartridges, or from other dirt and debris infiltrating the chamber. In certain embodiments, this filler may include a thermoplastic elastomer, rubber, fabric, non-woven material, or other such material. In certain embodiments, the insert 110, 210 may be provided with fewer or greater than the disclosed six segments and slits, such as one slit and one segment, two, three, four, five, seven, eight, nine, ten, eleven, or twelve. In one embodiment that includes one slit, the one slit may traverse a partial length of the insert 110, 210 and terminating at a web, or it may traverse the entire length of the insert 110, 210 such that there is no web and the insert 110, 210 is akin to "C" shape in profile. Moreover, the principles of the invention may be embodied in other embodiments including structures that similarly provide a radially-outward bias for cartridge case extraction and can be selectively engaged with a cartridge while inserted into a firearm chamber. The inserts may be a sleeve-like constant-force spring such as a sheet of resilient metal wrapped once over itself, or wrapped less or more than once over itself, with the amount of overlap varying the diameter of the insert. In such embodiments, the chamber contracts when the coil of the spring is tightened, and the chamber expands when the tension on the spring is released. In other embodiments, inserts may be provided as a helical insert made from e.g. coiled wire, also known as a screw thread insert or STI. In such embodiments, the spring undergoes a twisting motion to tighten about the cartridge or a reversed twisting motion to loosen when in the out-of-battery configuration.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A gun barrel assembly, comprising:

a gun barrel formed of a material comprising steel and configured for firing a cartridge within a range from .17-.50 caliber;

a chamber at a proximal end of the gun barrel; and a chamber insert affixed in the chamber, the chamber insert dimensioned to extend along a body of a cartridge case and terminate proximate a neck of the cartridge case accommodated and fired by the gun barrel assembly, wherein the chamber insert defines an interior surface for interfacing the cartridge casing, and the chamber insert is formed of a material comprising one of a tungsten carbide, a tungsten heavy alloy, and a bulk metallic glass, and the material comprising an elastic modulus that is from about $60\times10^6$ psi to about $200\times10^6$ psi.

2. The gun barrel assembly of claim 1, wherein the chamber insert is configured to accommodate and extract a cartridge casing comprising steel due to the chamber insert comprising an elastic modulus of about two to six times greater than the elastic modulus of the cartridge casing.

3. The gun barrel assembly of claim 1, further comprising a cartridge casing formed of a material comprising steel, wherein the elastic modulus of the chamber insert is from about two to six times greater than the elastic modulus of the cartridge casing.

4. The gun barrel assembly of claim 1, wherein said gun barrel is shrunk fit onto said chamber insert.

5. The gun barrel assembly of claim 1, wherein the chamber insert comprises a radial wall thickness that is less than one half of a diameter of a body portion of the chamber insert.

* * * * *